US011767836B2

(12) United States Patent
Chou et al.

(10) Patent No.: US 11,767,836 B2
(45) Date of Patent: Sep. 26, 2023

(54) AIR COMPRESSOR

(71) Applicants: Wen-San Chou, Tainan (TW); Cheng-Hsien Chou, Tainan (TW)

(72) Inventors: Wen-San Chou, Tainan (TW); Cheng-Hsien Chou, Tainan (TW)

( * ) Notice: Subject to any disclaimer, the term of this patent is extended or adjusted under 35 U.S.C. 154(b) by 0 days.

(21) Appl. No.: 17/739,143

(22) Filed: May 8, 2022

(65) Prior Publication Data

US 2022/0372961 A1 Nov. 24, 2022

(30) Foreign Application Priority Data

May 19, 2021 (TW) ..... 110118147

(51) Int. Cl.

| | |
|---|---|
| ***F04B 35/04*** | (2006.01) |
| ***F04B 39/06*** | (2006.01) |
| ***F04B 39/12*** | (2006.01) |
| ***F04B 53/22*** | (2006.01) |
| ***F04B 39/14*** | (2006.01) |

(52) U.S. Cl.

CPC ..... *F04B 35/04* (2013.01); *F04B 39/066* (2013.01); *F04B 39/121* (2013.01); *F04B 53/22* (2013.01); *F04B 39/14* (2013.01)

(58) Field of Classification Search

CPC ..... F04B 35/04; F04B 39/066; F04B 39/121; F04B 39/14; F04B 53/22

See application file for complete search history.

(56) References Cited

U.S. PATENT DOCUMENTS

| | | | | |
|---|---|---|---|---|
| 6,629,827 | B2 * | 10/2003 | Chou | F04B 35/04 417/415 |
| 7,318,422 | B2 * | 1/2008 | Douyama | F04B 17/03 123/495 |
| 8,629,583 | B2 * | 1/2014 | Bernhardt | H02K 7/14 310/91 |

(Continued)

FOREIGN PATENT DOCUMENTS

| | | |
|---|---|---|
| CN | 206283384 | 6/2017 |
| EP | 3670911 | 6/2020 |

(Continued)

OTHER PUBLICATIONS

"Search Report of Europe Counterpart Application", dated Sep. 12, 2022, pp. 1-9.

(Continued)

*Primary Examiner* — Christopher S Bobish
(74) *Attorney, Agent, or Firm* — JCIPRNET

(57) ABSTRACT

An air compressor contains: a body, a cylinder, a motor, and a transmission mechanism. The body includes multiple positioning orifices which are a first positioning orifice and a second positioning orifice. The cylinder is connected on the body and communicates with an air storage holder. The motor is fixed on the body, a small gear is received in the first positioning orifice, and a connection seat of the motor is accommodated in the first orifice. The transmission mechanism actuates the piston to move in the cylinder reciprocately so as to produce compressed airs. The motor further includes multiple fixing portions extending from a head edge of the casing thereof and configured to engage with the body, thus fixing the motor on the body securely without using any screws.

2 Claims, 6 Drawing Sheets

(56) References Cited

U.S. PATENT DOCUMENTS

| | | | | |
|---|---|---|---|---|
| 10,047,737 | B2 * | 8/2018 | Meza | F04B 53/16 |
| 2008/0199324 | A1 * | 8/2008 | Yang | F04B 33/005 417/234 |
| 2014/0127060 | A1 * | 5/2014 | Richter | F04D 29/406 417/423.7 |
| 2015/0110652 | A1 * | 4/2015 | Hoshi | F04D 13/02 417/420 |
| 2015/0330379 | A1 * | 11/2015 | Chou | F04B 39/0094 417/374 |
| 2015/0337825 | A1 * | 11/2015 | Chou | F04B 37/18 417/415 |
| 2018/0223824 | A1 * | 8/2018 | Inoue | F04B 39/14 |
| 2020/0208620 | A1 | 7/2020 | Chou et al. | |
| 2022/0178366 | A1 * | 6/2022 | Beaudry | F04B 53/22 |

FOREIGN PATENT DOCUMENTS

| | | |
|---|---|---|
| JP | S55144871 | 10/1980 |
| JP | 3204419 | 6/2016 |
| JP | 2020097936 | 6/2020 |
| JP | 3238310 | 7/2022 |
| KR | 20180061540 | 6/2018 |

OTHER PUBLICATIONS

"Office Action of Japan Counterpart Application", dated Jun. 27, 2023, p. 1-p. 3.

* cited by examiner

AIR COMPRESSOR

FIELD OF THE INVENTION

The present invention relates to an air compressor which is capable of fixing the motor on a body of the air compressor and the air compressor is received in an accommodation box without using any screws.

BACKGROUND OF THE INVENTION

A conventional air compressor contains a body, a cylinder connected on the body, a motor fixed on the body, and a piston driven by the motor to move in the cylinder reciprocately, such that the motor actuates the piston to move in the cylinder reciprocately, thus sucking, compressing, and discharging airs. Furthermore, the air compressor is received in an accommodation box.

The motor is fixed on the body by screws, but it is easy to remove from the body after a period of using time. When the screws are inserted through the body to screw with multiple threaded orifices of a casing of the motor, a tool is difficult to screw the screws with the multiple threaded orifices in a limited space. Therefore, the motor cannot be fixed on the body by using the screws easily.

The present invention has arisen to mitigate and/or obviate the afore-described disadvantages.

SUMMARY OF THE INVENTION

The primary aspect of the present invention is to provide an air compressor which is received in an accommodation box, the motor further includes at least one fixing portion extending from a head edge thereof and configured to engage with the body, thus fixing the motor on the body securely without using any screws.

Another aspect of the present invention is to provide an air compressor in which the accommodation box includes multiple columns extending from inner walls of an upper housing and a lower housing of the accommodation box and corresponding to the two dissipation holes, such that when the air compressor is received in the accommodation box, the multiple columns of the accommodation box are engaged in the two dissipation holes so that the motor does not remove from the body when the air compressor is hit to turn over.

DETAILED DESCRIPTION OF THE PREFERRED EMBODIMENTS

Figure 1:
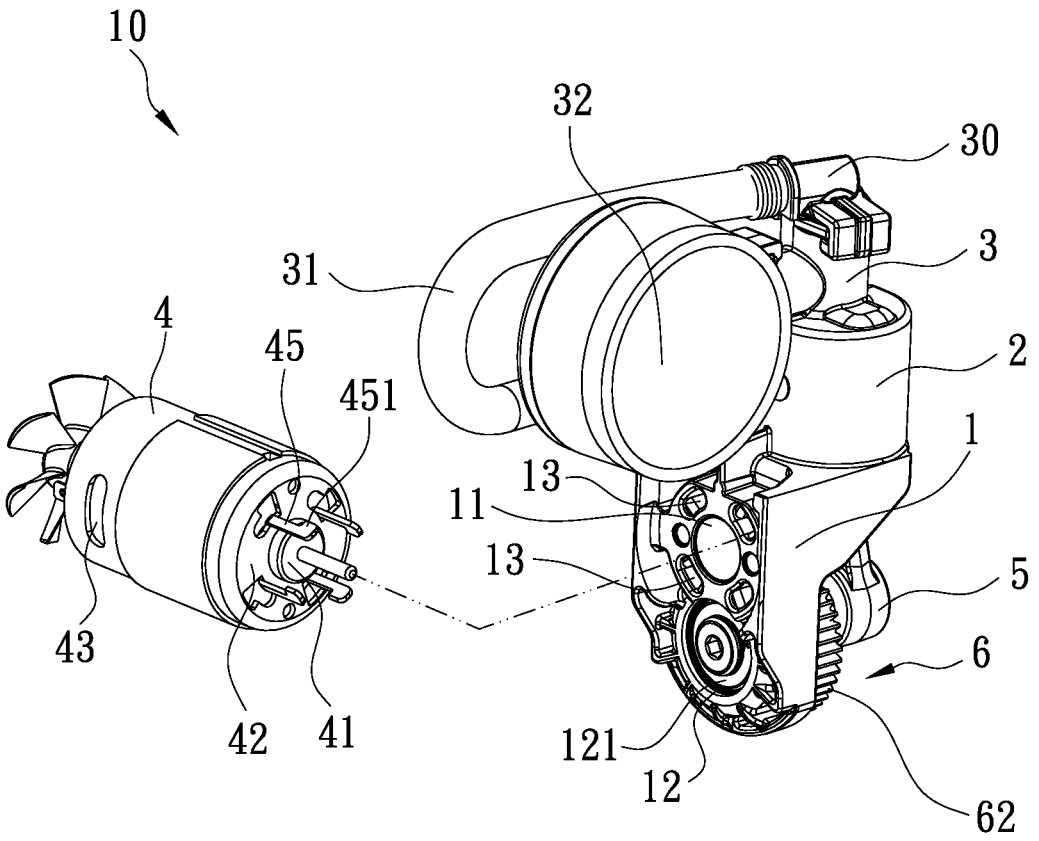
FIG. 1 is a perspective view showing the exploded components of an air compressor according to a preferred embodiment of the present invention.
Figure 2:
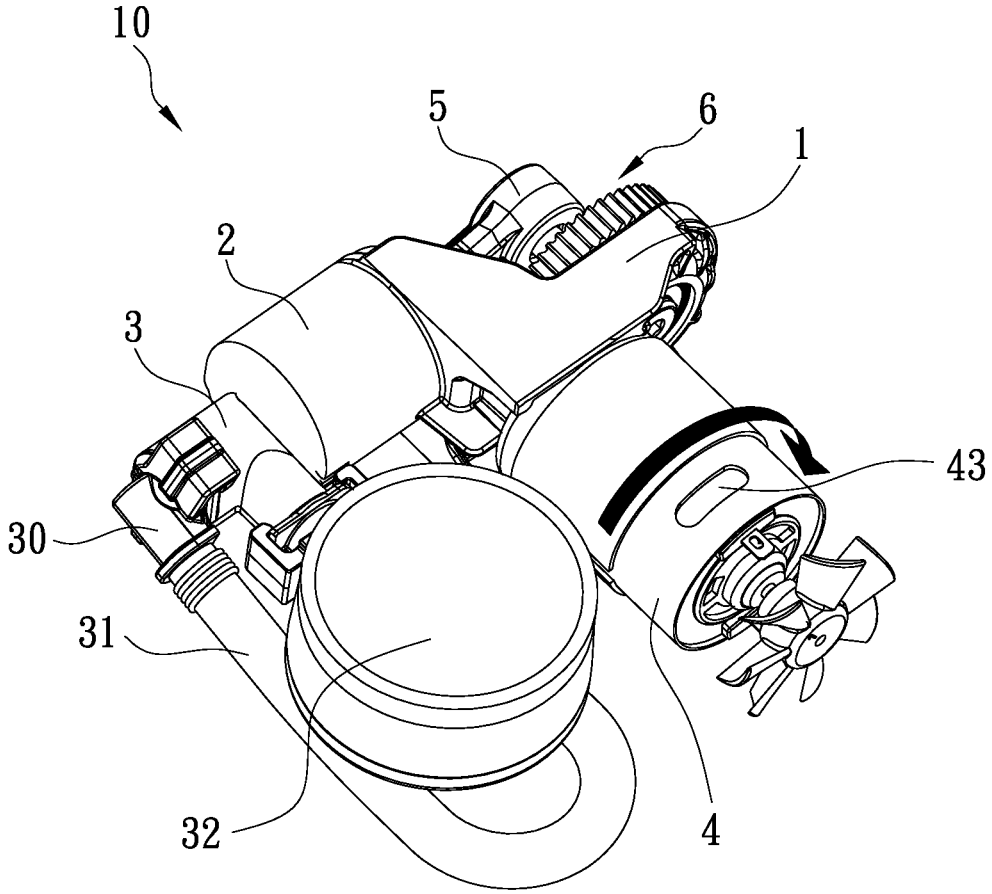
FIG. 2 is a perspective view showing the assembly of the air compressor according to the preferred embodiment of the present invention.
Figure 3:
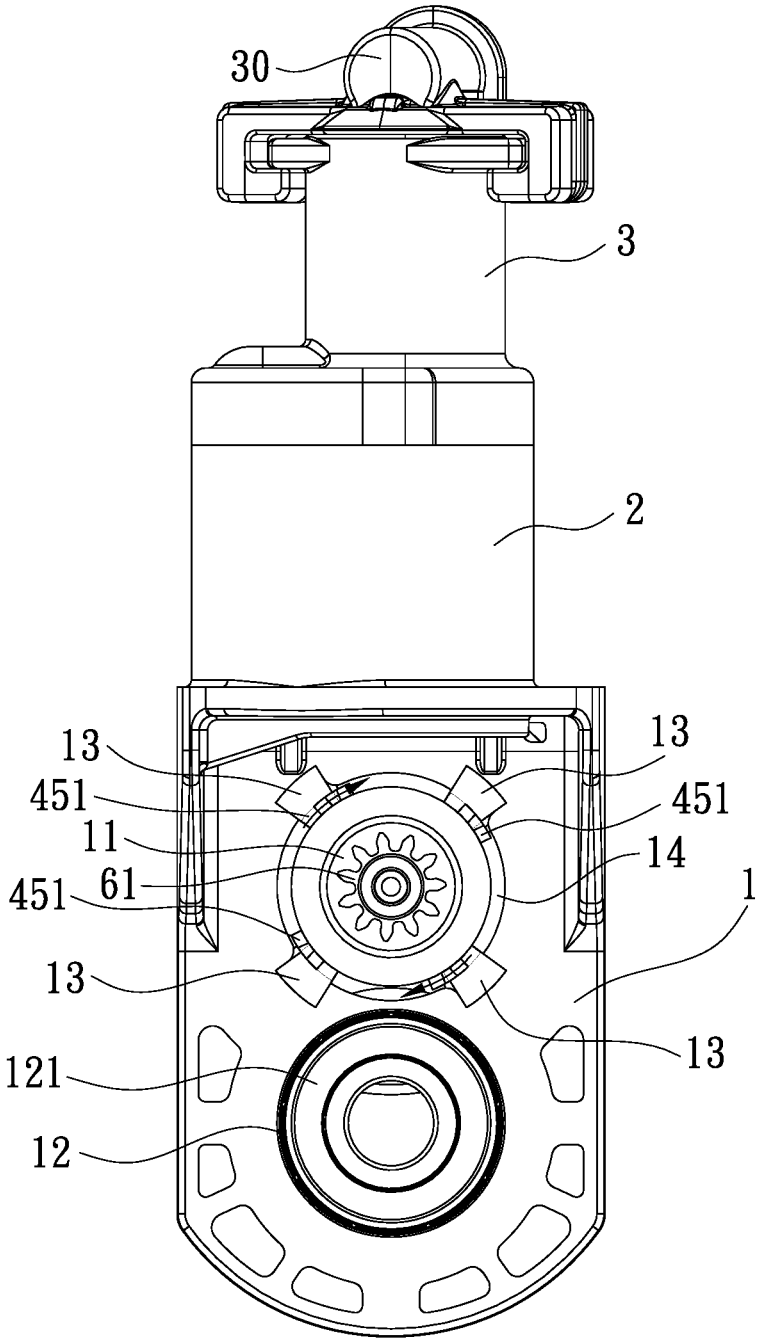
FIG. 3 is a side plan view showing the operation of a part of the air compressor according to the preferred embodiment of the present invention.
Figure 4:
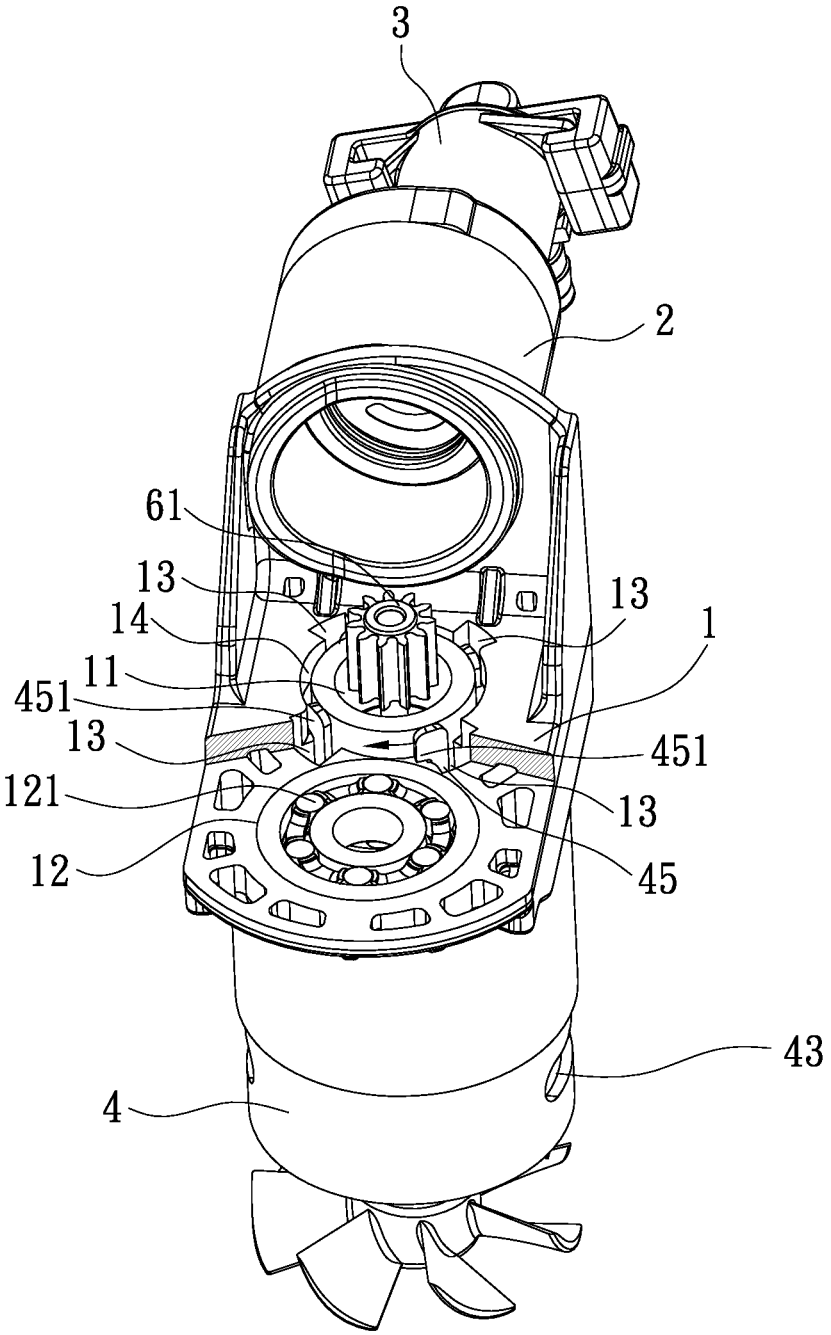
FIG. 4 is a cross-sectional perspective view showing the assembly of a part of the air compressor according to the preferred embodiment of the present invention.

With reference to FIGS. 1-4, an air compressor 10 according to a preferred embodiment of the present invention comprises: a body 1, a cylinder 2 connected on the body 1, a motor 4 fixed on the body 1, and a piston 5 driven by the motor 4 to move in the cylinder 2 reciprocately.

The body 1 includes multiple positioning orifices which are a first positioning orifice 11 and a second positioning orifice 12, wherein a small gear 61 is received in the first positioning orifice 11 and is connected on an end of the motor 4, and a connection seat 41 of the motor 4 is accommodated in the first orifice 11. The second positioning orifice 12 is configured to receive a bearing 121. The motor 4 further includes two dissipation holes 43 symmetrically formed on two sides of the casing thereof and configured to circulate airs and to dissipate heat from the motor 4.

The cylinder 2 is one-piece connected on the body 1 and is in communication with an air storage holder 3, wherein the air storage holder 3 includes at least one tube 30 in which an air hose 31 and a pressure gauge 32 are received.

A transmission mechanism 6 includes a large gear 62 having a counterweight block and configured to mesh with the small gear 61, wherein the large gear 62 is connected with a bearing 121 by using shaft (not shown), and the transmission mechanism 6 actuates the piston 5 to move in the cylinder 2 reciprocately so as to produce compressed airs.

Referring to FIGS. 1-6, the motor 4 further includes multiple fixing portions 45 extending from a head edge 42 of the casing thereof, and a respective one fixing portion 45 has a hook 451 extending from a distal end thereof. The body 1 further includes multiple through orifices 13 corresponding to the multiple fixing portions 45, and a receiving groove 14 surrounding adjacent to the first positioning orifice 11. The multiple fixing portions 45 extends through the multiple through orifices 13 of the body 1 so that when the motor 4 rotates, the hooks 451 of the distal ends of the multiple fixing portions 45 abut against the receiving groove 14, thus fixing the motor 4 on the body 1 securely without using any screws.

Figure 5:
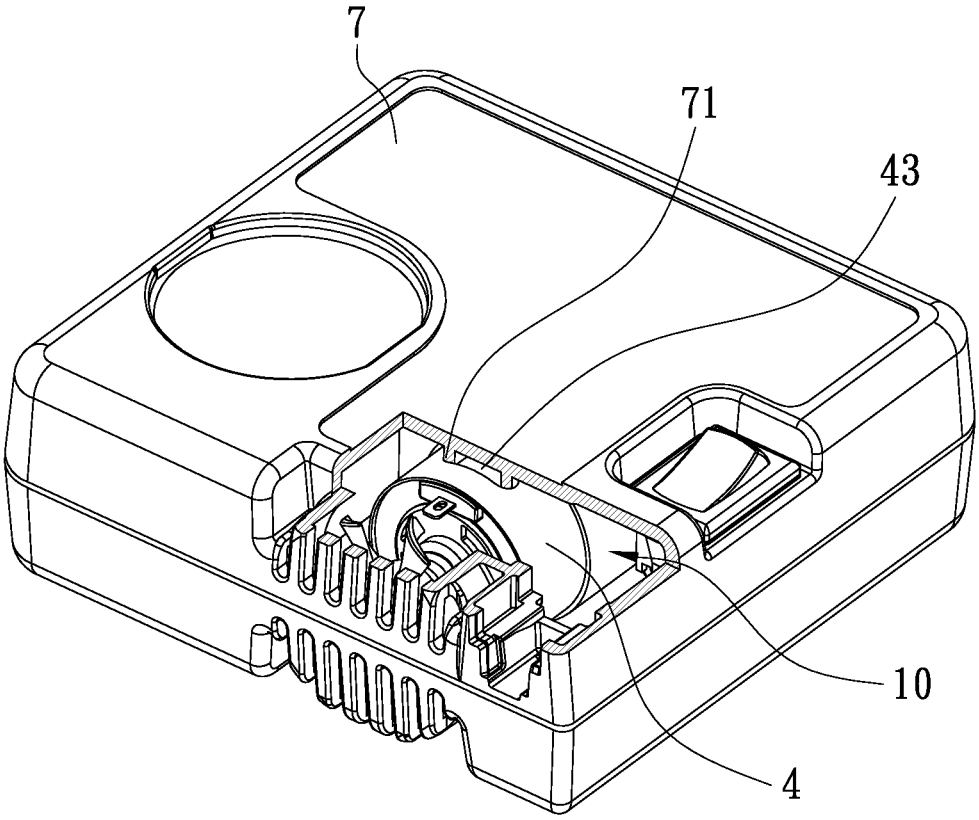
FIG. 5 is a perspective view showing the air compressor being received in an accommodation box according to the preferred embodiment of the present invention.
Figure 6:
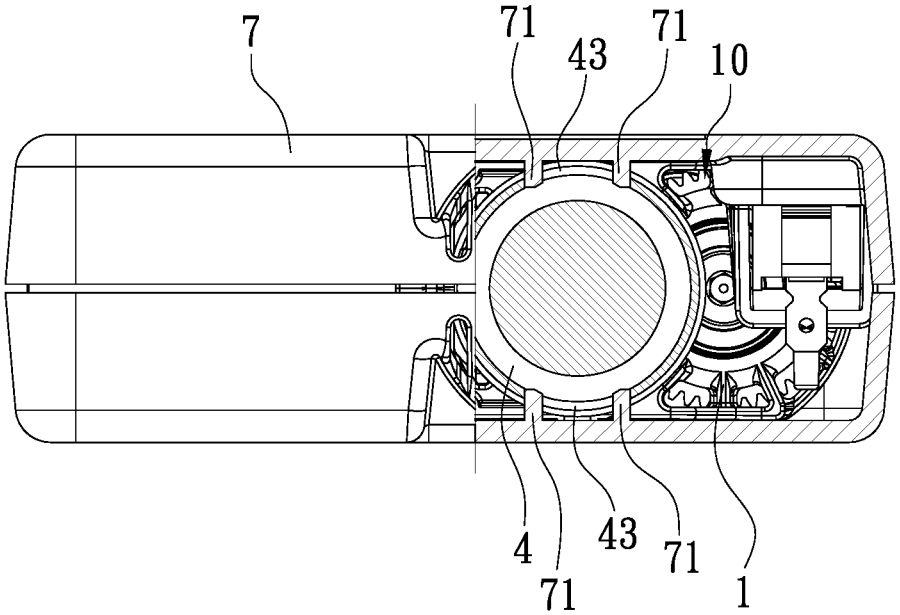
FIG. 6 is a cross sectional view of the air compressor of FIG. 5.

Referring to FIGS. 5 and 6, the air compressor 10 is received in an accommodation box 7. The accommodation box 7 includes multiple columns 71 extending from inner walls of an upper housing and a lower housing of the accommodation box 7 and corresponding to the two dissipation holes 43, such that when the air compressor 10 is received in the accommodation box 7, the multiple columns 71 of the accommodation box 7 are engaged in the two dissipation holes 43 so that the motor 4 does not remove from the body 1 when the air compressor 10 is hit to turn over.

Thereby, the multiple fixing portions 45 of the head edge 42 of the motor 4 are engaged with the body 1 of the air compressor 10 so that the motor 4 is fixed on the body 1 securely without using any screws, and the air compressor 10 is received in the accommodation box 7, wherein the two dissipation holes 43 of the motor 4 are limited by the multiple columns 71 of the accommodation box 7 so that the motor 4 does not remove from the body 1.

While the preferred embodiments of the invention have been set forth for the purpose of disclosure, modifications of the disclosed embodiments of the invention and other embodiments thereof may occur to those skilled in the art.

Accordingly, the appended claims are intended to cover all embodiments which do not depart from the spirit and scope of the invention.

What is claimed is:

1. An air compressor comprising:

a body including multiple positioning orifices which are a first positioning orifice and a second positioning orifice;

a cylinder connected on the body and communicating with an air storage holder;

a motor fixed on the body and a small gear being received in the first positioning orifice, and a connection seat of the motor being accommodated in the first positioning orifice;

a transmission mechanism actuating a piston to move in the cylinder reciprocately so as to produce compressed airs;

wherein the motor further includes at least one fixing portion extending from a head edge thereof and configured to engage with the body, thus fixing the motor on the body securely without using any screws, wherein the motor further includes a casing and two dissipation holes, and the two dissipation holes are symmetrically formed on two sides of the casing and configured to circulate airs and to dissipate heat from the motor, wherein the air compressor is received in an accommodation box, the accommodation box includes multiple columns extending from inner walls of an upper housing and a lower housing of the accommodation box and corresponding to the two dissipation holes, such that when the air compressor is received in the accommodation box, the multiple columns of the accommodation box are engaged in the two dissipation holes so that the motor does not remove from the body when the air compressor is hit to turn over.

2. The air compressor as claimed in claim 1, wherein the at least one fixing portion further includes multiple fixing portions extending from the head edge of the casing thereof, and each of the multiple fixing portions has a hook extending from a distal end thereof, the body further includes multiple through orifices corresponding to the multiple fixing portions, and a receiving groove surrounding adjacent to the first positioning orifice; the multiple fixing portions extends through the multiple through orifices of the body so that when the motor rotates, the hooks of the distal ends of the multiple fixing portions abut against the receiving groove, thus fixing the motor on the body securely without using any screws.

* * * * *